US007980107B2

(12) United States Patent
Li

(10) Patent No.: US 7,980,107 B2
(45) Date of Patent: Jul. 19, 2011

(54) VARIABLE DIAMETER PIPE EXPANDER

(76) Inventor: Xiaoyong Li, Shanghai (CN)

( * ) Notice: Subject to any disclaimer, the term of this patent is extended or adjusted under 35 U.S.C. 154(b) by 173 days.

(21) Appl. No.: 12/286,407

(22) Filed: Sep. 29, 2008

(65) Prior Publication Data

US 2009/0084551 A1 Apr. 2, 2009

(51) Int. Cl.
*E21B 23/02* (2006.01)
*B21D 41/02* (2006.01)
*B21J 7/16* (2006.01)

(52) U.S. Cl. ..... 72/75; 72/393; 72/462; 166/380

(58) Field of Classification Search ..... 72/75, 119, 72/393, 462; 166/380
See application file for complete search history.

(56) References Cited

U.S. PATENT DOCUMENTS

| | | | | |
|---|---|---|---|---|
| 1,930,825 | A * | 10/1933 | Raymond | 72/75 |
| 3,201,827 | A * | 8/1965 | Reynolds et al. | 72/462 |
| 3,640,115 | A * | 2/1972 | Duncan et al. | 72/393 |
| 3,818,734 | A * | 6/1974 | Bateman | 72/75 |
| 3,934,443 | A * | 1/1976 | Keen | 72/75 |
| 4,512,178 | A * | 4/1985 | Blevins et al. | 72/393 |
| 6,457,532 | B1 * | 10/2002 | Simpson | 72/119 |
| 6,702,030 | B2 * | 3/2004 | Simpson | 166/380 |

* cited by examiner

*Primary Examiner* — David B Jones

(57) ABSTRACT

A reducing pipe expander that applies to casing deformation restoration of deep wells such as oil field and comprises a conical-nosed enclosure, a mandrel and several steel balls. The main body of the enclosure is equipped with several radial slotted holes to nest steel balls. Held by a taper, slant or curved face against insides of the slotted holes, the steel balls move axially, overhanging the enclosure. When the deformed casing pipe or patching pipe obstructs the pipe expander from moving forward, the steel balls will move in the reverse direction of the movement of the expander to directly expand the deformed pipe. When the expander can pass through the casing pipe or patching pipe, the steel balls will be free to return to their original status.

7 Claims, 1 Drawing Sheet

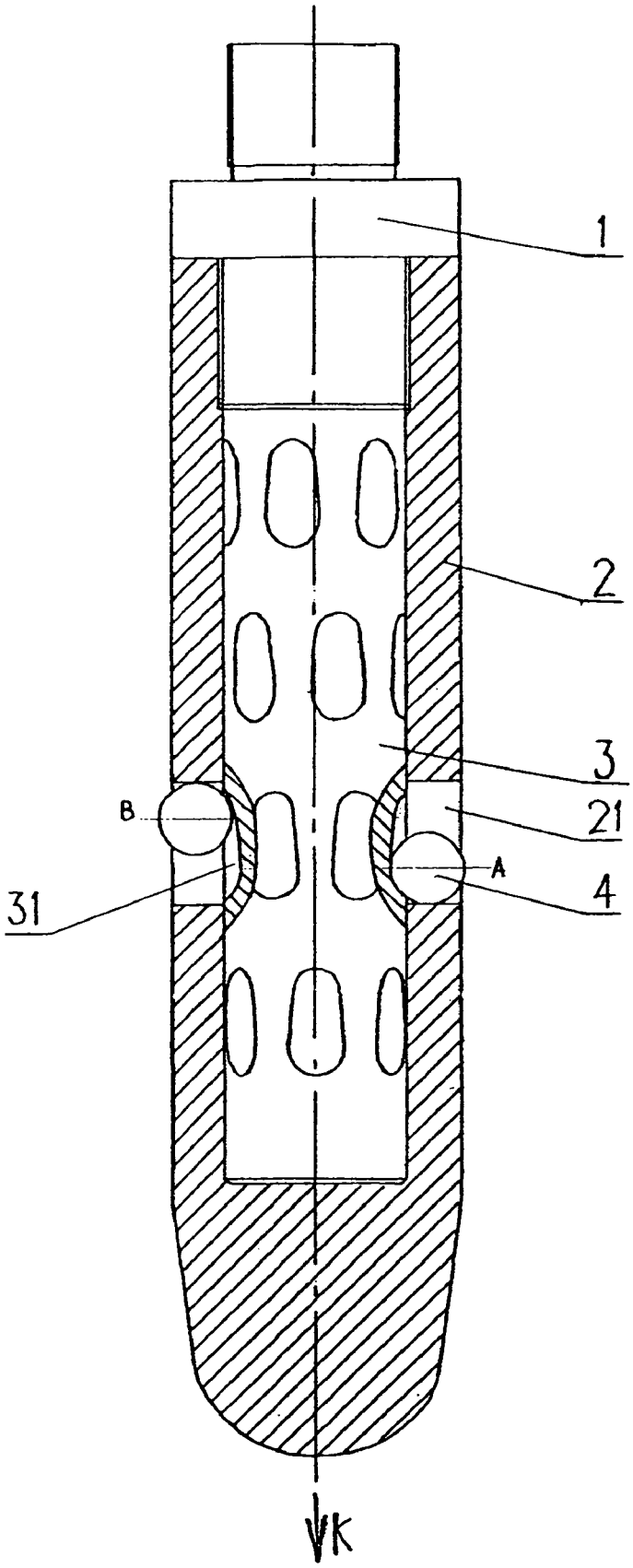
1
2
3
21
4
A
B
31
K

VARIABLE DIAMETER PIPE EXPANDER

TECHNICAL FIELD

This invention relates to a variable diameter pipe expander, especially the one used to restore any deformation of casing pipes or patching pipes, suitable for casing deformation restoration of deep wells such as in oil fields.

BACKGROUND TECHNOLOGY

Casing pipes or patching pipes under an oil, gas or water well are always subject to deformation, wearing and diameter reduction during their use as a result of corrosion and crust movement, so that the well cannot work. The casing pipes are conventionally reshaped with the following technologies: reshaping using pear-shaped equipment, milling, and explosive reshaping. The reshaping using pear-shaped equipment includes lowering the pear-shaped equipment with a caisson down to where the casing pipe is deformed, and then expanding the casing pipe by impaction. The shortcoming of this technique is that the casing pipe's inside diameter will be smaller than the standard diameter, because elastic deformation may cause the expanded casing pipe to resile. The milling technique involves grinding or milling the deformed casing pipe. It may cause damage to the casing pipe. The common disadvantage of the two technologies above lies in a great labor intensity resulting from lifting and lowering the caisson for several times. The explosive shaping technique involves lowering explosives down to where the casing is deformed and then igniting the explosives to blast the deformed casing. However, the casing may also be damaged because of the explosion.

The applicant of this invention has disclosed a variable diameter expansion head in Chinese Patent Application No. 200620039368.X. The head is housed in a conical-nose enclosure. The main body of the enclosure is equipped with radial cylindrical holes to embed small steel balls, its internal longitudinal side is equipped with large steel balls and pads, and its bottom is equipped with springs. When a forward thrust overcomes the spring pressure, the small steel ball in front of the large steel ball will be pushed outwards by the large steel ball to where the expanded casing is deformed. In this way, the casing's diameter can be restored.

Well restoration has been partly solved by using the variable diameter expansion head with lower cost and good expansion effect.

However, there is still some deficiency existing in use of the expansion head. It is not a problem of expansion effect but that the head is subject to easy breaking in the process of expansion. Probably because a great down pressure is imposed on the steel ball in expansion and the inside of the enclosure is composed of the steel ball and the pad so that stress is centralized at the inside of the expansion head, whose structure is not tight enough.

SUMMARY OF THE INVENTION

The above-described technical problems can be solved by using this invention which is a variable diameter pipe expander that provides a good expansion effect, is equipped with an integrated and unbreakable mandrel and can be repeatedly used.

The technical solution used by invention for the technical problem above is: a variable diameter pipe expander that comprises a conical-nosed enclosure, a mandrel and several steel balls. The main body of the enclosure is equipped with several radial slotted holes to embed steel balls. Held by a tapered, slanted or curved face against insides of the slotted holes, the steel balls move axially, always having a projecting overhang on the outside of the enclosure. When repairing the deformed casing pipe or patching pipe, the variable diameter pipe expander is inserted inside the pipe and made to move in a direction K. When the deformed casing pipe or patching pipe obstructs the pipe expander from moving forward, the steel balls will move in the reverse direction of K to directly expand the deformed pipe. When the enclosure of the expander can pass through the casing pipe or patching pipe, the steel balls will move in the K direction to return to their original status.

The mandrel of this variable diameter pipe expander uses an integrated structure, which greatly increases the expander's strength so that the expansion head is hardly breakable even if used for many times. Additionally, the structure of this pipe expander is simpler than that of any pipe expander of the conventional technology.

There are several grooves on the mandrel, corresponding to the slotted holes on the enclosure. The bottom of each groove is a taper, slant or curved face.

The steel balls embedded in the slotted holes are larger when located away from the nose of the enclosure than located close to the nose.

The enclosure fits the mandrel closely or excessively.

The steel balls and the slotted holes housing the steel balls are distributed evenly on the enclosure and each pair of adjacent slotted holes are staggered.

The expander is flexibly joined with connectors to allow it swinging within 90° to the K direction and enable it to automatically find a passage when encountering a bend of the casing pipe.

The advantages of this invention include:

1. When the expander encounters a diameter change of the casing pipe or the patching pipe in the course of moving down, the steel balls will automatically move up, so as to expand the pipe. No additional pressure is required, thus an energy saving is achieved.

2. The mandrel is integrated, thus greatly increases the expander's strength and enables repeated use without breaking.

3. The diameter of the reshaped casing pipe is not less than the standard diameter. The expander can automatically find a passage and make a turn when encountering a bend of the pipe.

BRIEF DESCRIPTION OF THE FIGURES

FIG. 1 represents a cross sectional view of the structure of the variable diameter pipe expander, in which reference numerals denote the following:

1—-Connector
2—-Enclosure
21—-Slotted Hole
3—-Mandrel
31—-Groove
4—-Steel Ball

DETAILED DESCRIPTION OF THE INVENTION

Please refer to the illustration of FIG. 1, which represents the structure of the variable diameter pipe expander. The variable diameter pipe expander comprises a conical-nosed enclosure 2, a mandrel 3 and several steel balls 4. The main body of the enclosure 2 is equipped with several radial slotted holes 21 to embed the steel balls. The steel balls 4 are always having a projecting overhang on the outside of the enclosure 2 and freely movable in a direction K from A (close to the nose) to B (away from the nose).

There are several grooves 31 on the mandrel 3, corresponding to the slotted holes 21 on the enclosure 2. The bottom of the groove 31 is a curved face. The steel ball 4 moves inside the slotted hole 21, held by the curved face against the inside. The steel ball 4 is more larger at position B than at position A.

The enclosure 2 fits the mandrel 3 closely or excessively.

The steel ball 4 and the slotted hole 21 are distributed on the enclosure 2 and each pair of adjacent slotted holes are staggered.

The variable diameter pipe expander is inserted into the deformed casing pipe or patching pipe in the direction K. When the deformed casing pipe or patching pipe obstructs the pipe expander from moving forward, the steel balls will move in the reverse direction of K to directly expand the deformed pipe. When the enclosure of the pipe expander can pass through the casing pipe or patching pipe freely, the steel balls will move downwards in the K direction to return to their original status.

The pipe expander is flexibly joined with the connector 1 to allow the expander to swing within 90° to K direction and enable the expander to automatically find a passage when encountering a bend of the casing pipe.

When the variable diameter pipe expander moves forwards in the direction of K and the deformed casing pipe or patching pipe obstructs the pipe expander from moving forward, the steel balls will be the first to touch the deformed casing pipe as a result of its projecting overhang location and will move upwards in the reverse direction of K under the friction force between them. In the process of the movement, the steel balls will produce expansion motions and directly expand the internal wall of the deformed casing pipe or patching pipe. When the casing pipe or patching pipe can pass through the enclosure of the expander, the steel balls will move downwards in the K direction to return to their original status.

Additionally, hardness of the mandrel is much higher than that of the enclosure so that toughness of the mandrel is much lower than that of the enclosure. In this case, when they encounter a heavy external force, the flexible enclosure can prevent the mandrel, even if it is broken, from falling down and avoid consequential accidents.

The same problem exists in U.S. Pat. No. 6,702,030B2. The forces from different directions under the well make the metal enclosure embedding the steel balls easily distorted and deformed and even broken. In a practice case of the patent, all steel balls are embedded in one tapered face instead of several slants or curved faces on the cylindrical face. In this way, it can do nothing when casing deformation occurs because it cannot produce a larger radius of curvature with a longer cylinder.

The invention claimed is:

1. A pipe expander, comprising:

a cylindrical enclosure having a cylindrical body connected to an enclosed nose end and a plurality of radial slotted holes on the cylindrical body, the cylindrical body having a substantially uniform diameter and a longitudinal axis, a mandrel located inside the enclosure, and a plurality of steel balls, each of the steel balls located between one of the slotted holes and the mandrel such that said each steel ball has a projecting overhang outside the enclosure, said each steel ball movable in said one slotted hole along a direction substantially parallel to the longitudinal axis, wherein the enclosed nose end has a curved envelope.

2. The pipe expander according to claim 1, wherein the mandrel is stationary relative to the enclosure and comprises a plurality of elongated grooves thereon, each corresponding to one of the slotted holes, and each of the elongated grooves has a tapered, slanted or curved surface for holding one of the steel balls.

3. The pipe expander according to claim 2, wherein each of the elongated grooves has a first end and an opposing second end, wherein the enclosed nose end is closer to the second end than to the first end, and wherein the elongated grooves are so shaped that the projecting overhang of said steel ball is larger when said steel ball is located in the first end than when said steel ball is located in the second end.

4. The pipe expander according to claim 3, wherein the first end is narrower than the second end.

5. The pipe expander according to claim 1, wherein the slotted holes are arranged in rows along the longitudinal axis such that the slotted holes in adjacent rows are distributed on the enclosure in a staggered way such that corresponding slotted holes in the adjacent rows are offset from each other with respect to the longitudinal axis.

6. The pipe expander according to claim 1, wherein the expander is flexibly joined with a connector.

7. A method for restoring diameter of a deformed pipe, comprising:

inserting, nose first, a pipe expander inside the deformed pipe, and moving the pipe expander along the direction of the deformed pipe by an external force, wherein the pipe expander comprises a cylindrical enclosure having a cylindrical body connected to an enclosed nose end a plurality of radial slotted holes on the cylindrical body, the cylindrical body having a substantially uniform diameter and a longitudinal axis, a mandrel located inside the enclosure stationary relative to the enclosure, the mandrel comprising a plurality of elongated grooves, each of the grooves corresponding to one of the slotted holes, and a plurality of steel balls, each of the steel balls located between one of the slotted holes and the mandrel such that said each steel ball has a projecting overhang outside the enclosure, said each steel ball movable in said one slotted hole along a direction substantially parallel to the longitudinal axis, wherein the enclosed nose end has a curved envelope, wherein each of the elongated grooves has a first end and an opposing second end, wherein the enclosed nose end is closer to the second end than to the first end, and wherein the elongated grooves are so shaped that the projecting overhang of said steel ball is larger when said steel ball is located in the first end than when said steel ball is located in the second end, and wherein when the pipe obstructs the pipe expander from moving forward, the steel balls move in the reverse direction of the movement of the pipe expander to increase the overhang, so as to expand the deformed pipe diameter-wise.

* * * * *